US006547200B2

(12) United States Patent
Dilworth

(10) Patent No.: US 6,547,200 B2
(45) Date of Patent: Apr. 15, 2003

(54) TEXTILE HANGING SYSTEM

(76) Inventor: Roby J. Dilworth, 241 County Rd., Carthage, MO (US) 64836

( * ) Notice: Subject to any disclaimer, the term of this patent is extended or adjusted under 35 U.S.C. 154(b) by 0 days.

(21) Appl. No.: 09/967,675

(22) Filed: Sep. 28, 2001

(65) Prior Publication Data

US 2002/0060279 A1 May 23, 2002

Related U.S. Application Data

(60) Provisional application No. 60/238,279, filed on Oct. 5, 2000.

(51) Int. Cl.[7] ..... A47F 5/00

(52) U.S. Cl. ..... 248/316.5; 248/316.1; 211/45; 24/67.9

(58) Field of Search ..... 248/316.5, 316.1, 248/316.2, 316.7, 451, 452; 211/45; 40/790, 781, 611, 617; 24/67.9, 543, 30.5 R; 411/522, 354; 223/90, 91, 93, 96, 92, 85; 38/102.1

(56) References Cited

U.S. PATENT DOCUMENTS 632,159 A * 8/1899 Steward ..... 160/393
2,056,878 A * 10/1936 Wineholt ..... 211/88.04
3,767,092 A * 10/1973 Garrison et al. ..... 223/96
4,899,974 A * 2/1990 Wear et al. ..... 211/45
5,251,766 A * 10/1993 Barry ..... 211/89.01
5,711,430 A * 1/1998 Andersen et al. ..... 211/45
5,895,023 A * 4/1999 Chao ..... 248/451
D436,137 S * 1/2001 Grant et al. ..... D20/41
6,257,422 B1 * 7/2001 Rios ..... 211/45
6,266,854 B1 * 7/2001 Ancona et al. ..... 24/499
6,279,204 B1 * 8/2001 Gonzalez ..... 24/16 R

* cited by examiner

*Primary Examiner*—Korie Chan
*Assistant Examiner*—Ingrid Weinhold

(57) ABSTRACT

A textile hanging system for receiving and displaying a flexible textile sheet in a vertical manner. The textile hanging system includes a first support member pivotally attached to a second support member, a first engaging member and a second engaging member attached to the first support member and the second support member respectively, a first member and a second member attached to a distal end of the first support member and the second support member respectively, and a pair of end members having a receiving slot that selectively engage the first member and the second member for retaining the support members juxtaposed to one another. The engaging members are positioned within the opposing inner surfaces of the support members and are positioned opposite of the pivot portion thereof. The textile sheet is positioned between the support members and the support members are compressed against the textile sheet by the end members being positioned about the first member and the second member.

18 Claims, 7 Drawing Sheets

TEXTILE HANGING SYSTEM

CROSS REFERENCE TO RELATED APPLICATIONS

Cross-reference to Related U.S. Patent Application

I hereby claim benefit under Title 35, United States Code, Section 119(e) of U.S. provisional patent application Ser. No. 60/238,279 filed Oct. 5, 2000 and entitled Quilt Hanging System. This application is a continuation of the 60/238,279 application. The 60/238,279 application is currently pending. The 60/238,279 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to hanging devices and more specifically it relates to a textile hanging system for receiving and displaying a flexible textile sheet in a vertical manner.

Textiles sheets, such as quilts and the like, are often displayed in a vertical manner to illustrate the entire product. Often times these textile sheets are secured to a flat vertical wall for displaying to the general public. However, it is often times difficult to display the textile sheet in a convenient manner and there is currently a need for a textile hanging system that allows individuals to easily display textile sheets without requiring significant labor.

2. Description of the Prior Art

Examples of patented devices which are related to the present invention include U.S. Pat. No. 5,592,721 and U.S. Pat. No. 5,170,982. Both of these patents illustrate technology that requires the usage of a cylinder or other elongate member to "wedge" the textile sheet into a channel within a bracket structure.

The main problem with conventional textile hanging devices is that they are difficult for the user to simultaneously insert and align the textile sheet up into the channel while also engaging the cylinders or other engaging members. Another problem with conventional textile hanging devices is that they are cumbersome to utilize and often times require two or more individuals to secure the textile sheet within. Another problem with conventional textile hanging devices is that they are prone to allowing the textile sheet to shift during the securing of the textile sheet within the bracket structure. Another problem with conventional textile hanging devices is that they sometimes cause damage to the textile sheet by applying excessive clamping pressure upon the textile sheet.

A problem with conventional textile hanging devices that utilize a plurality of clamping members is that certain designs allow for the textile sheet to sag in between the plurality of clamping members which can cause the textile sheet to be undesirably stretched. A further problem is that a plurality of fasteners must be inserted into a wall with the usage of a plurality of clamping members.

While these devices may be suitable for the particular purpose to which they address, they are not as suitable for receiving and displaying a flexible textile sheet in a vertical manner. Conventional textile sheet display devices are cumbersome to utilize and require a significant amount of time to properly display a textile sheet.

In these respects, the textile hanging system according to the present invention substantially departs from the conventional concepts and designs of the prior art, and in so doing provides an apparatus primarily developed for the purpose of receiving and displaying a flexible textile sheet in a vertical manner.

SUMMARY OF THE INVENTION

In view of the foregoing disadvantages inherent in the known types of textile hanging devices now present in the prior art, the present invention provides a new textile hanging system construction wherein the same can be utilized for receiving and displaying a flexible textile sheet in a vertical manner.

The general purpose of the present invention, which will be described subsequently in greater detail, is to provide a new textile hanging system that has many of the advantages of the textile hanging devices mentioned heretofore and many novel features that result in a new textile hanging system which is not anticipated, rendered obvious, suggested, or even implied by any of the prior art textile hanging devices, either alone or in any combination thereof.

To attain this, the present invention generally comprises a first support member pivotally attached to a second support member, a first engaging member and a second engaging member attached to the first support member and the second support member respectively, a first member and a second member attached to a distal end of the first support member and the second support member respectively, and a pair of end members having a receiving slot that selectively engage the first member and the second member for retaining the support members juxtaposed to one another. The engaging members are positioned within the opposing inner surfaces of the support members and are positioned opposite of the pivot portion thereof. The textile sheet is positioned between the support members and the support members are compressed against the textile sheet by the end members being positioned about the first member and the second member.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a textile hanging system that will overcome the shortcomings of the prior art devices.

A second object is to provide a textile hanging system for receiving and displaying a flexible textile sheet in a vertical manner.

Another object is to provide a textile hanging system that allows an individual to secure and display a textile sheet without requiring assistance by another.

An additional object is to provide a textile hanging system that reduces the time and labor required to hang a textile sheet.

A further object is to provide a textile hanging system that may be utilized to secure various types of textile sheets such as but not limited to quilts, blankets, rugs, and sheets.

Another object is to provide a textile hanging system that is capable of receiving and displaying various sizes, widths and weights of textile sheets.

A further object is to provide a textile hanging system that allows for easy periodic changing of a textile display.

Another object is to provide a textile hanging system that does not require significant pressure applied to the textile sheet during usage.

A further object is to provide a textile hanging system that is aesthetically pleasing and which may be molded to accent the textile sheet.

Another object is to provide a textile hanging system that does not damage or distort the textile sheet during extended periods of display.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
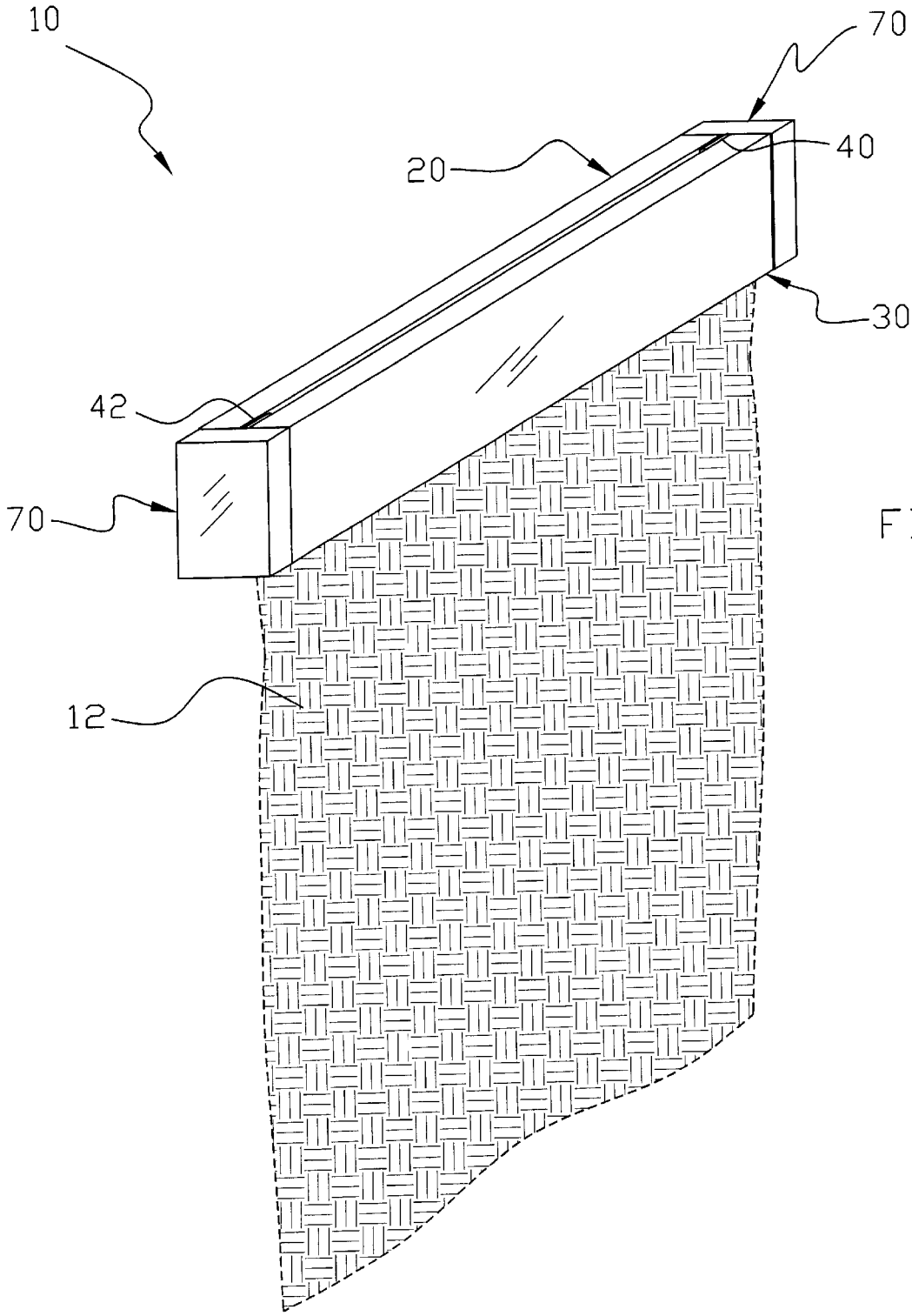
FIG. 1 is an upper perspective view of the present invention retaining a textile sheet within.

Turning now descriptively to the drawings, in which similar reference characters denote similar elements throughout the several views, FIGS. 1 through 8 illustrate a textile hanging system 10, which comprises a first support member 20 pivotally attached to a second support member 30, a first engaging member 60 and a second engaging member 62 attached to the first support member 20 and the second support member 30 respectively, a first member 50 and a second member 52 attached to a distal end of the first support member 20 and the second support member 30 respectively, and a pair of end members 70 having a receiving slot 72 that selectively engages the first member 50 and the second member 52 for retaining the support members 20, 30 juxtaposed to one another. The engaging members 60, 62 are positioned within the opposing inner surfaces of the support members and are positioned opposite of the pivot portion thereof. The textile sheet 12 is positioned between the support members 20, 30 and the support members 20, 30 are compressed against the textile sheet 12 by the end members 70 being positioned about the first member 50 and the second member 52.

Figure 2:
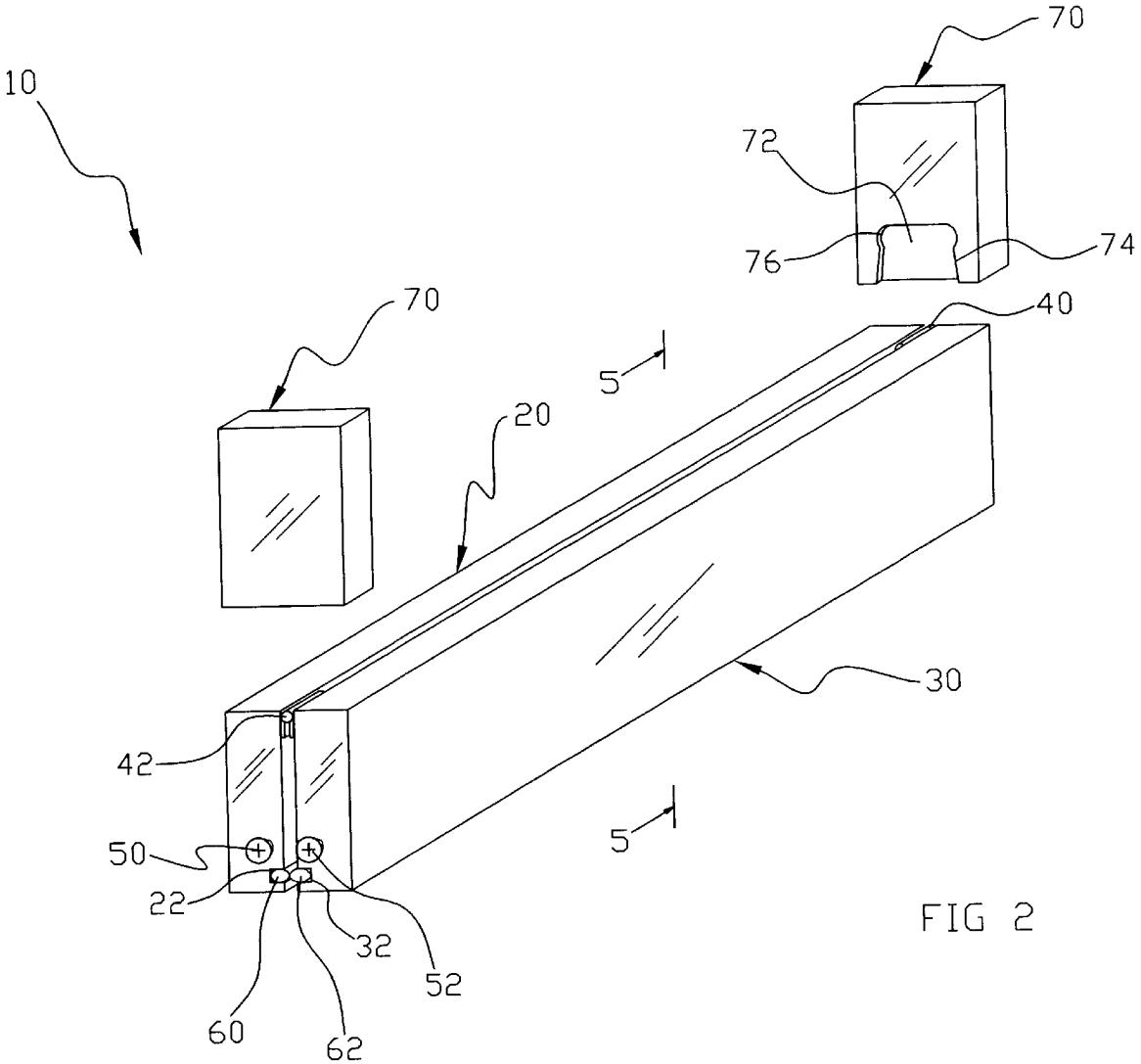
FIG. 2 is an exploded upper perspective view of the present invention.

As best illustrated in FIGS. 1 and 2 of the drawings, the support members 20, 30 are comprised of an elongate structure. The support members 20, 30 are preferably sufficient in length to receive an entire width of the textile sheet 12 as shown in FIG. 1 of the drawings. However, it can be appreciated that the support members 20, 30 may be shorter in length than the width of the textile sheet 12. The support members 20, 30 preferably have mirrored structures, however differing structures may be utilized to construct the support members 20, 30. The support members 20, 30 may have various cross sectional shapes as can also be appreciated.

Figure 4:
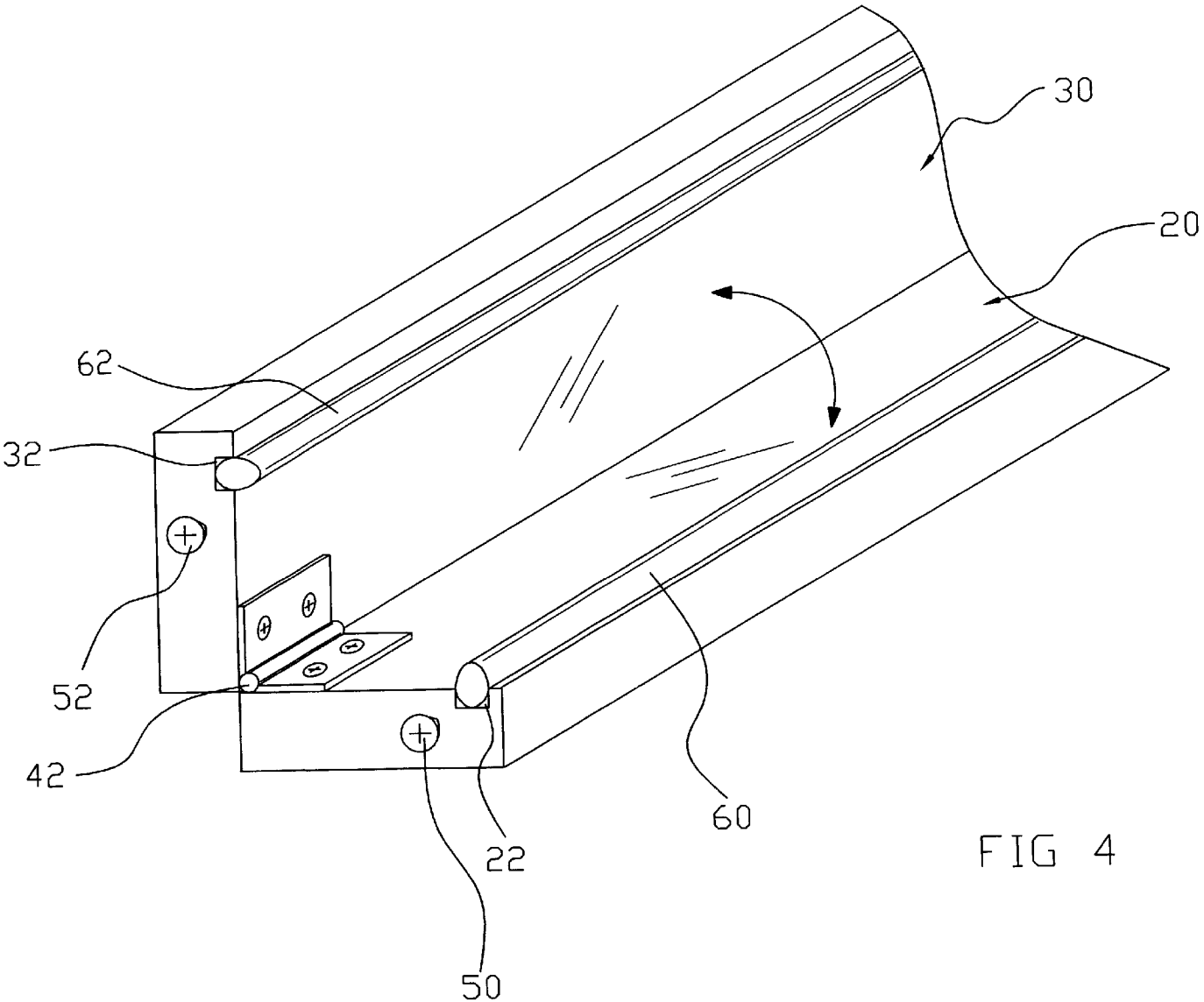
FIG. 4 is an upper perspective view of the present invention in the open position.
Figure 5:
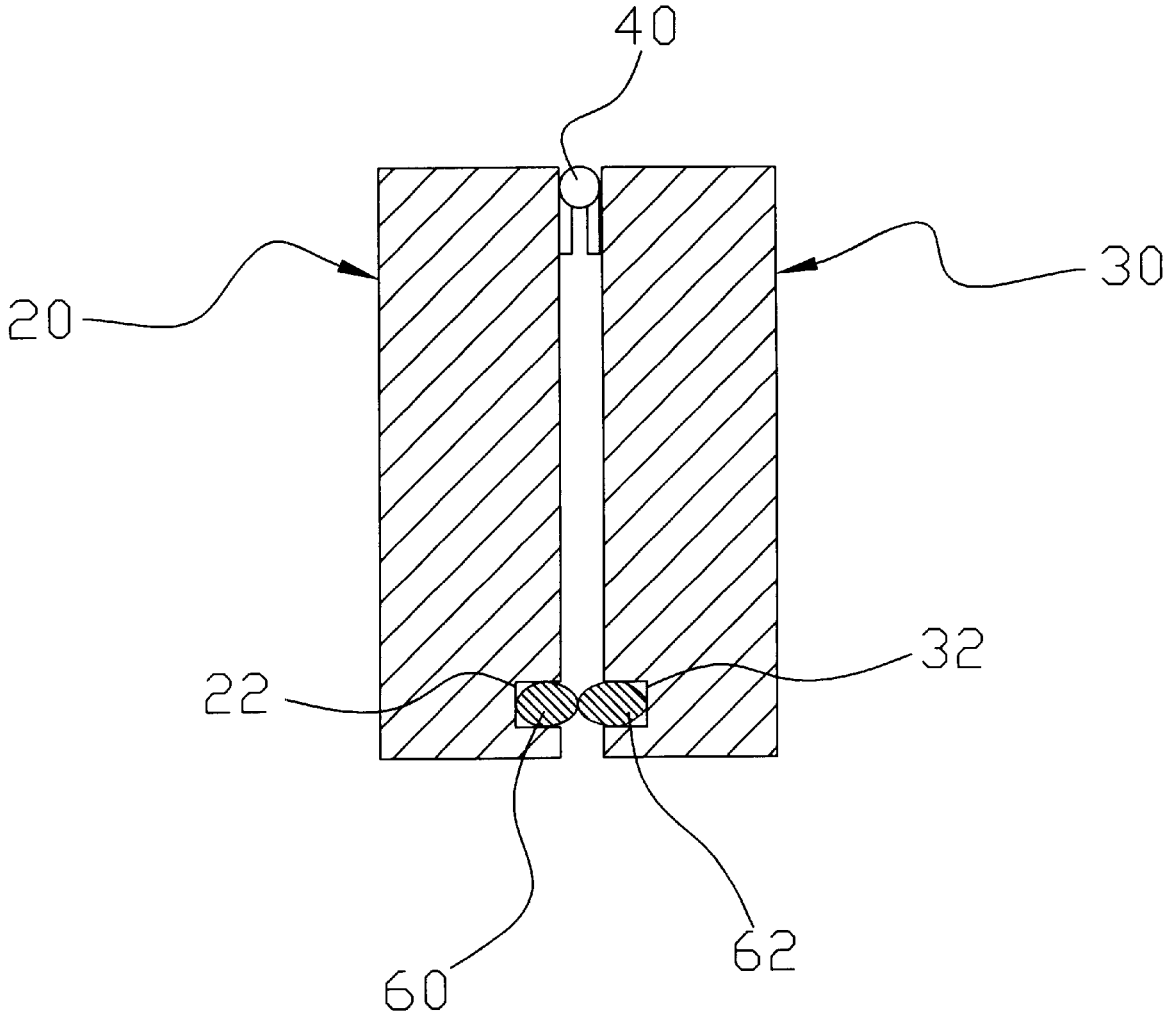
FIG. 5 is a cross sectional view taken along line 5—5 of FIG. 2.

As shown in FIGS. 1, 2, 4 and 5 of the drawings, the support members 20, 30 are pivotally attached to one another by one or more hinges 40, 42. The hinges 40, 42 may be comprised of any conventional hinge structure. The hinges 40, 42 are attached to an upper portion 76 of the support members 20, 30 so as to positions the inner surfaces of the support members 20, 30 substantially parallel to one another when in a closed position as best shown in FIG. 5 of the drawings. The hinges 40, 42 allow the support members 20, 30 to be expanded away from one another for insertion of the textile sheet 12 as best shown in FIG. 4 of the drawings.

As shown in FIGS. 2, 4 and 5 of the drawings, a first slot 22 preferably extends along a lower portion of the inner surface of the first support member 20 in opposition to the second support member 30. The first slot 22 is formed for receiving the first engaging member 60 in a manner substantially parallel to the longitudinal axis of the first support member 20. It can be appreciated that the first engaging member 60 may be secured within the first slot 22 utilizing various types of fasteners, adhesives and the like. It can also be appreciated that the first engaging member 60 may be frictionally and snugly secured within the first slot 22 as best shown in FIG. 5 of the drawings. The first engaging member 60 may also be attached directly to the inner surface of the first support member 20 without the usage of a first slot 22

As shown in FIGS. 2, 4 and 5 of the drawings, a second slot 32 preferably extends along a lower portion 74 of the inner surface of the second support member 30 in opposition to the first support member 20 and the first slot 22. The second slot 32 is formed for receiving the second engaging member 62 in a manner substantially parallel to the longitudinal axis of the second support member 30. It can be appreciated that the second engaging member 62 may be secured within the second slot 32 utilizing various types of fasteners, adhesives and the like. It can also be appreciated that the second engaging member 62 may be frictionally and snugly secured within the second slot 32 as best shown in FIG. 5 of the drawings. The second engaging member 62 may also be attached directly to the inner surface of the second support member 30 without the usage of a second slot 32.

The first engaging member 60 and the second engaging member 62 are preferably engageable with one another when the support members 20, 30 are within the closed position as shown in FIG. 5 of the drawings. The engaging members 60, 62 may also have various cross sectional shapes including but not limited to circular, square, rectangular, oval and the like. The engaging members 60, 62 are preferably constructed of a resilient gripping material such as but not limited to rubber or foam core which will not damage the textile sheet 12 positioned between thereof. The engaging members 60, 62 have an elongate structure approximately equal to the length of the support members 20, 30. It can be appreciated that more than one first engaging member 60 and one second engaging member 62 may be utilized to construct the present invention.

As shown in FIG. 2 of the drawings, a first member 50 is attached to each of the opposing ends of the first support member 20. The first member 50 is preferably positioned within a lower portion of the first support member 20 as best shown in FIG. 2 of the drawings. The first member 50 is preferably comprised of a flanged end structure such as but not limited to a screw-like fastener.

As shown in FIG. 2 of the drawings, a second member 52 is attached to each of the opposing ends of the second support member 30. The second member 52 is preferably positioned within a lower portion of the second support member 30 as best shown in FIG. 2 of the drawings. The second member 52 is preferably comprised of a flanged end structure such as but not limited to a screw-like fastener. As shown in FIG. 2 of the drawings, the first member 50 and the second member 52 are preferably similar in shape and size.

Figure 3:
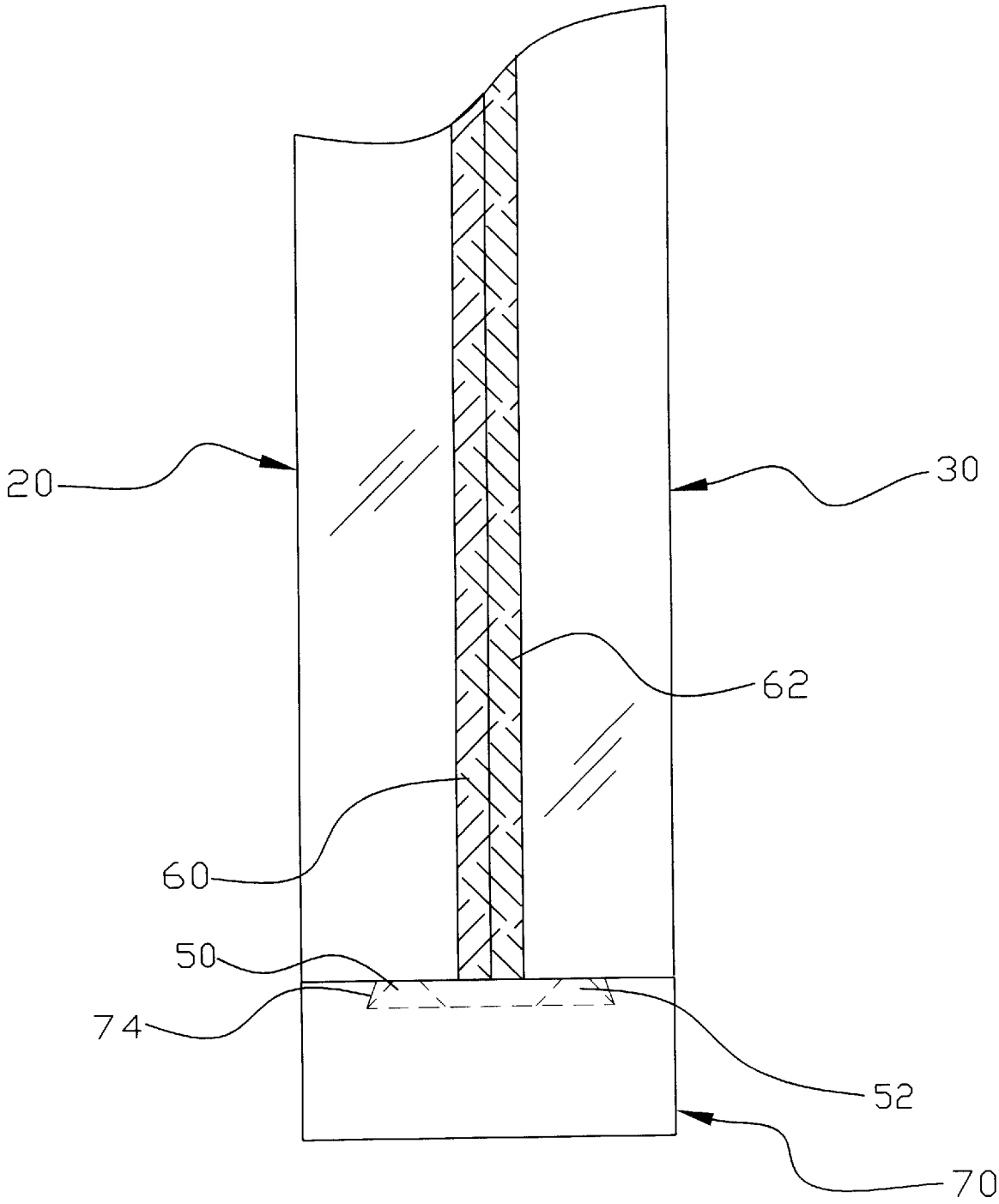
FIG. 3 is a magnified top view of the end member received about the extended members.

As shown in FIGS. 1 and 2 of the drawings, a pair of end members 70 are formed for catchably engaging the members 50, 52 on opposing ends of the support members 20, 30 to close the support members 20, 30 and for retaining the textile sheet 12 between the support members 20, 30. The end members 70 each have a body structure having a receiving slot 72 that receives the members 50, 52 as best shown in FIG. 2 of the drawings. The receiving slot 72 has a dovetail structure for snugly receiving the members 50, 52 between thereof as best shown in FIG. 3 of the drawings. The receiving slot 72 has a lower portion 74 that is tapered outwardly toward the lower portion 74 of the ends members and an engaging portion 76 that is broader than the upper end of the lower portion 74 as best shown in FIG. 2 of the drawings. The engaging portion 76 of the receiving slot 72 catchably receives the members 50, 52 within when the end members 70 are positioned about the members 50, 52 thereby retaining the support members 20, 30 in a closed position.

Figure 7:
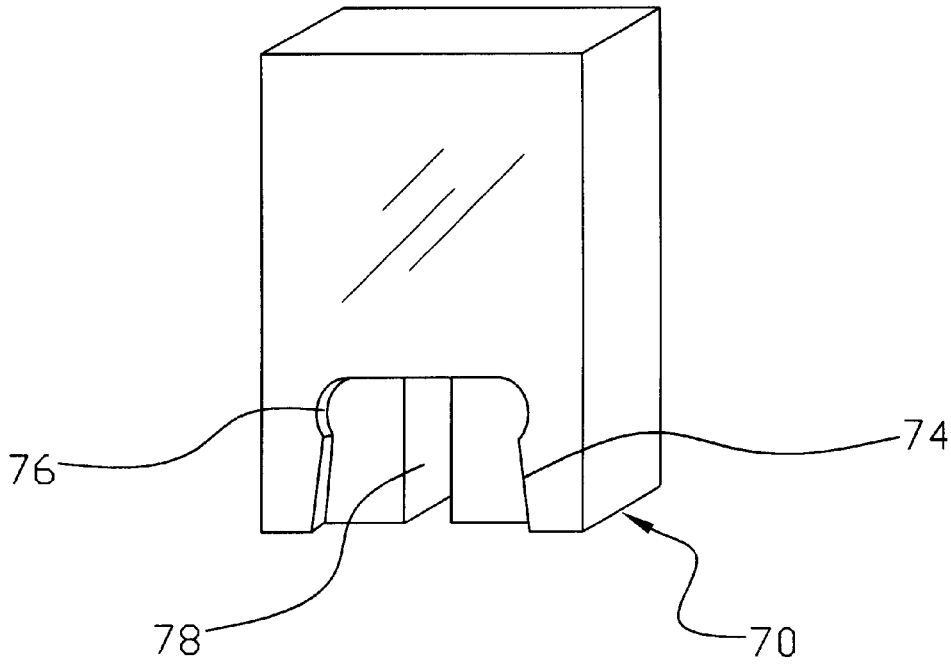
FIG. 7 is an upper perspective view of a second alternative embodiment of the end member.
Figure 8:
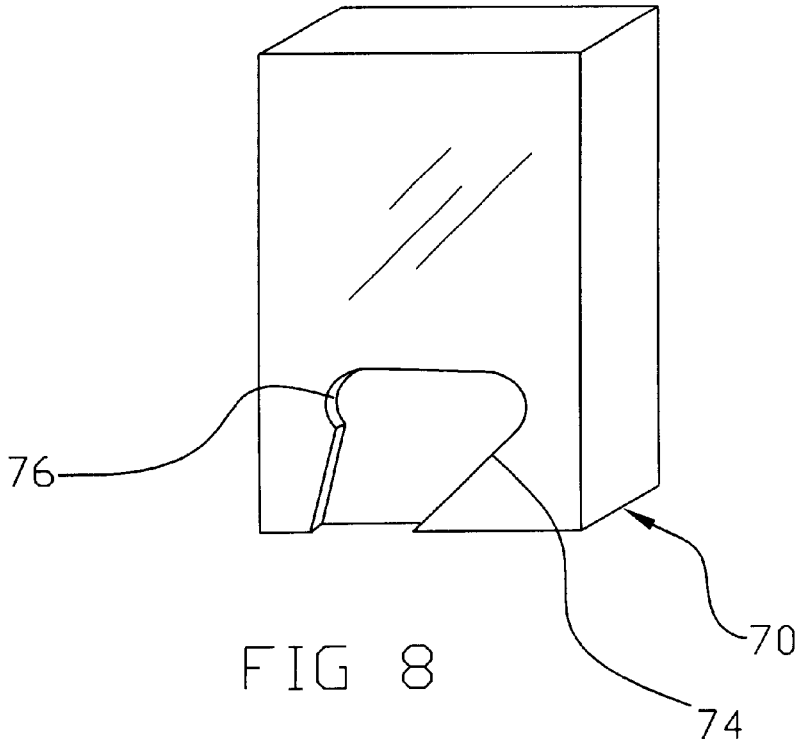
FIG. 8 is an upper perspective view of a third alternative embodiment of the end member.

Various alternative embodiments of the end members 70 may be utilized. For example, FIG. 7 illustrates the usage of a cutout 78 within the end members 70 for allowing a textile sheet 12 to extend through wherein the textile sheet 12 has a width greater than the length of the support members 20, 30. FIG. 8 illustrates the usage of a receiving slot 72 with a lower portion 74 having an angled structure wherein one of the members 50, 52 would be inserted into first and then the remaining of the members 50, 52 inserted into the receiving slot 72 afterwards to be snugly received by the upper portion 76 of the receiving slot 72.

Figure 6:
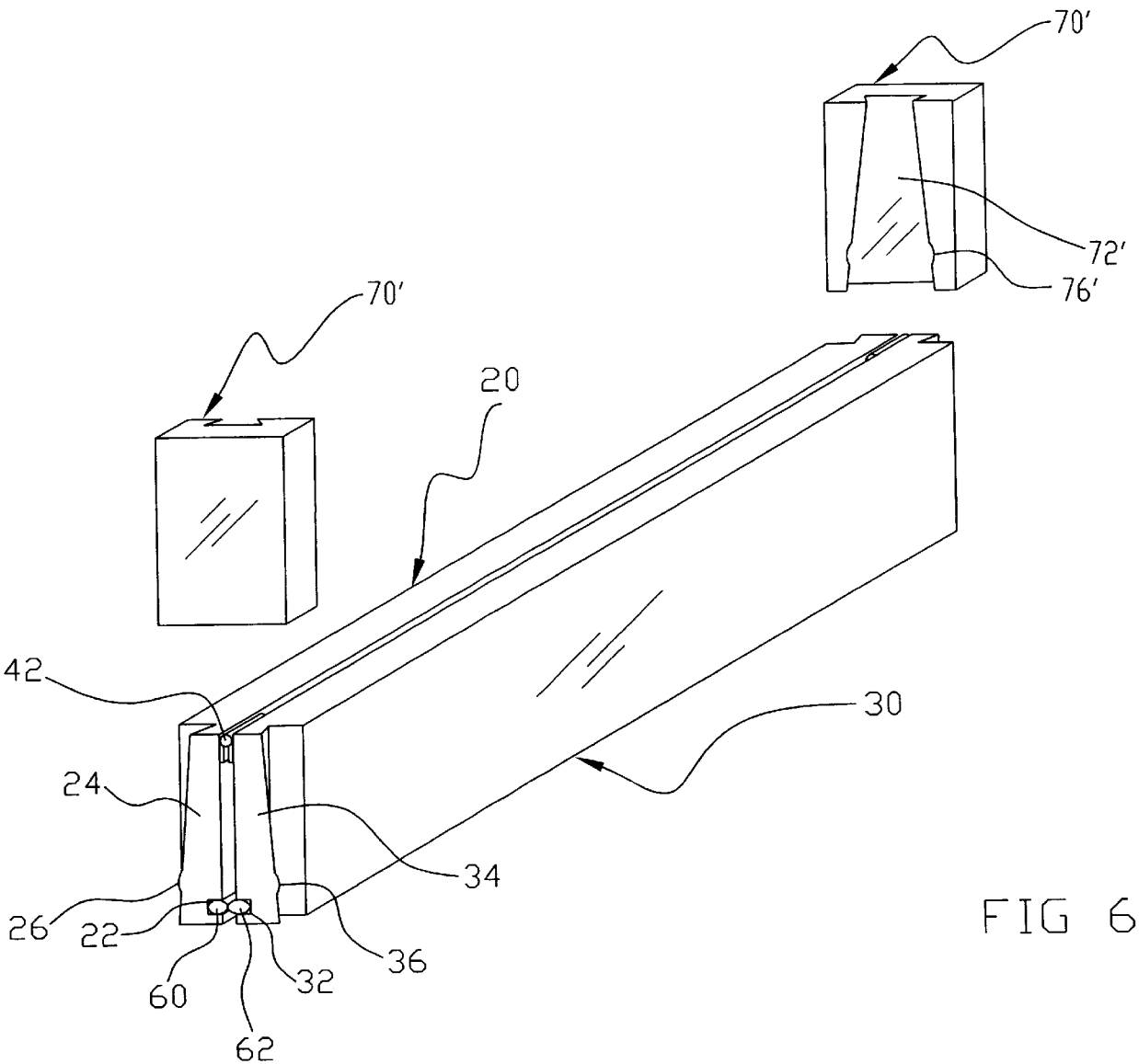
FIG. 6 is an upper perspective view of a first alternative embodiment of the present invention.

FIG. 6 illustrates an alternative embodiment of the present invention wherein the first support member 20 includes a first flanged member 24 having a first extended portion 26 extending from opposing ends thereof. As further shown in FIG. 6, the second support member 30 includes a second flanged member 34 having a second extended portion 36 extending from opposing ends thereof in opposition to the first flanged member 24 respectively. The flanged members 24, 34 have a dovetailed structure that snugly mates with the receiving slot 72' that has a tapered structure as shown in FIG. 6. The receiving slot 72' within the end members 70' extends from the bottom to the top for receiving a significant portion of the flanged members 24, 34. The extended portions 26, 36 are catchably received within the engaging portion 76' of the respective receiving slot 72'.

In use, the user removes the end members 70 from the support members 20, 30 and opens the support members 20, 30 with respect to one another as shown in FIG. 4 of the drawings. The user then inserts an end of the textile sheet 12 in between the support members 20, 30 and adjusting the textile sheet 12 within until properly positioned. The user then closes the support members 20, 30 about the textile sheet 12 so that the engaging members 60, 62 are adjacent the textile sheet 12 on opposing sides and then the user applies a contracting force upon the support members 20, 30 thereby compressing the engaging members 60, 62. The user then secures one of the end members 70 about the members 50, 52 at one end of the support members 20, 30. The user then secures the remaining of the end members 70 to the opposite end of the support members 20, 30 thereby compressing the support members and the engaging members 60, 62 upon the textile sheet 12. The user is then able to hang the textile sheet 12 upon a wall or other vertical structure utilizing a conventional bracket or fastener system. The textile sheet 12 is thereby supported in a vertical manner as shown in FIG. 1 of the drawings from the support members 20, 30. To remove the textile sheet 12, the user applies a contracting force upon the support members 20, 30 thereby compressing the engaging members 60, 62 which allows the user to remove the end members 70 from the support members 20, 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for Textile Hanging System

- ENVIRONMENTAL ELEMENTS

-continued

| Index of Elements for Textile Hanging System | |
|---|---|
| □ | |
| □ | |
| □ | |
| □ 10. | Textile Hanging System |
| □ 11. | |
| □ 12. | Textile Sheet |
| □ 13. | |
| □ 14. | |
| □ 15. | |
| □ 16. | |
| □ 17. | |
| □ 18. | |
| □ 19. | |
| □ 20. | First Support Member |
| □ 21. | |
| □ 22. | First Slot |
| □ 23. | |
| □ 24. | First Flanged Member |
| □ 25. | |
| □ 26. | First Extended Portion |
| □ 27. | |
| □ 28. | |
| □ 29. | |
| □ 30. | Second Support Member |
| □ 31. | |
| □ 32. | Second Slot |
| □ 33. | |
| □ 34. | Second Flanged Member |
| □ 35. | |
| □ 36. | Second Extended Portion |
| □ 37. | |
| □ 38. | |
| □ 39. | |
| □ 40. | First Hinge |
| □ 41. | |
| □ 42. | Second Hinge |
| □ 43. | |
| □ 44. | |
| □ 45. | |
| □ 46. | |
| □ 47. | |
| □ 48. | |
| □ 49. | |
| □ 50. | First Member |
| □ 51. | |
| □ 52. | Second Member |
| □ 53. | |
| □ 54. | |
| □ 55. | |
| □ 56. | |
| □ 57. | |
| □ 58. | |
| □ 59. | |
| □ 60. | First Engaging Member |
| □ 61. | |
| □ 62. | Second Engaging Member |
| □ 63. | |
| □ 64. | |
| □ 65. | |
| □ 66. | |
| □ 67. | |
| □ 68. | |
| □ 69. | |
| □ 70. | End Members |
| □ 71. | |
| □ 72. | Receiving Slot |
| □ 73. | |
| □ 74. | Lower Portion |
| □ 75. | |
| □ 76. | Upper Portion |
| □ 77. | |
| □ 78. | Cutout |
| □ 79. | |

I claim:

1. A textile hanging system for receiving and supporting a textile sheet in a vertical manner, comprising:

a first support member;

a pair of first members attached to opposing ends of said first support member;

a second support member pivotally attached to said first support member, wherein said second support member is substantially parallel to said first support member;

a pair of second members attached to opposing ends of said second support member;

a first engaging member attached to an inner surface of said first support member;

a second engaging member attached to an inner surface of said second support member in opposition to said first engaging member; and a pair of end members each having a receiving slot, wherein said receiving slot is tapered upwardly and wherein said receiving slot snugly receives one of said pair of first members and one of said pair of second members thereby retaining said first support member substantially parallel to said second support member.

2. The textile hanging system of claim 1, wherein said receiving slot is comprised of a lower portion and an upper portion, wherein said lower portion is exposed from a lower end of said end members and wherein said upper portion of said receiving slot is broader than an upper end of said lower portion.

3. The textile hanging system of claim 1, wherein said receiving slot is dovetailed.

4. The textile hanging system of claim 1, wherein said first members and said second members each have a flanged end.

5. The textile hanging system of claim 1, wherein said first engaging member and said second engaging member are comprised of a resilient material.

6. The textile hanging system of claim 1, including a first slot within said first support member for snugly receiving said first engaging member, and a second slot within said second support member for snugly receiving said second engaging member.

7. The textile hanging system of claim 1, wherein said first engaging member and said second engaging member are comprised of a resilient material.

8. The textile hanging system of claim 1, wherein said first engaging member and said second engaging member are comprised of a foam cord material.

9. A textile hanging system for receiving and supporting a textile sheet in a vertical manner, comprising:

a first support member;

a pair of first flanged members extending from opposing ends of said first support member;

a second support member pivotally attached to said first support member, wherein said second support member is substantially parallel to said first support member;

a pair of second flanged members extending from opposing ends of said second support member;

a first engaging member attached to an inner surface of said first support member;

a second engaging member attached to an inner surface of said second support member in opposition to said first engaging member; and a pair of end members each having a receiving slot, wherein said receiving slot is tapered upwardly and wherein said receiving slot snugly receives said flanged members thereby retaining said first support member substantially parallel to said second support member.

10. The textile hanging system of claim 9, wherein said receiving slot is dovetailed.

11. The textile hanging system of claim 9, including a cutout within each of said end members for allowing said textile sheet to extend through.

12. The textile hanging system of claim 9, wherein said receiving slot is comprised of a lower portion and an engaging portion, wherein said lower portion is exposed from a lower end of said end members and wherein said engaging portion of said receiving slot is broader than an upper end of said lower portion.

13. The textile hanging system of claim 9, wherein said receiving slot is dovetailed.

14. The textile hanging system of claim 9, wherein said first engaging member and said second engaging member are comprised of a resilient material.

15. A textile hanging system for receiving and supporting a textile sheet in a vertical manner, comprising:

a first support member;

a pair of first members attached to opposing ends of said first support member;

a second support member pivotally attached to said first support member, wherein said second support member is substantially parallel to said first support member;

a pair of second members attached to opposing ends of said second support member;

a first engaging member attached to an inner surface of said first support member;

a second engaging member attached to an inner surface of said second support member in opposition to said first engaging member;

a pair of end members each having a receiving slot, wherein said receiving slot is tapered upwardly and wherein said receiving slot snugly receives one of said pair of first members and one of said pair of second members thereby retaining said first support member substantially parallel to said second support member; and a cutout within each of said end members for allowing said textile sheet to extend through.

16. The textile hanging system of claim 15, wherein said receiving slot is tapered upwardly.

17. The textile hanging system of claim 15, wherein said receiving slot is comprised of a lower portion and an upper portion, wherein said lower portion is exposed from a lower end of said end members and wherein said upper portion of said receiving slot is broader than an upper end of said lower portion.

18. The textile hanging system of claim 15, wherein said receiving slot is dovetailed, and wherein said first member and said second member have a flanged end for snugly being received within said receiving slot.

* * * * *